United States Patent [19]

Olyphant, Jr.

[11] Patent Number: 4,533,784

[45] Date of Patent: Aug. 6, 1985

[54] SHEET MATERIAL FOR AND A CABLE HAVING AN EXTENSIBLE ELECTRICAL SHIELD

[75] Inventor: Murray Olyphant, Jr., Lake Elmo, Minn.

[73] Assignee: Minnesota Mining and Manufacturing Co., St. Paul, Minn.

[21] Appl. No.: 518,433

[22] Filed: Jul. 29, 1983

[51] Int. Cl.[3] ..... H01B 11/06

[52] U.S. Cl. ..... 174/36; 174/102 R; 174/102 D

[58] Field of Search ..... 174/36, 102 R, 102 D; 29/527.1; 72/379; 52/554, 555, 630; 428/595, 606

[56] References Cited

U.S. PATENT DOCUMENTS

| | | | |
|---|---|---|---|
| Re. 30,194 | 1/1980 | Bruno et al. | 174/102 D X |
| 2,372,323 | 3/1945 | Gordon | 174/102 R |
| 2,391,036 | 12/1945 | Rasmussen et al. | 174/102 R |
| 2,391,037 | 12/1945 | Schafer, Jr. | 174/102 R |
| 2,892,007 | 6/1959 | Rickards et al. | 174/36 |
| 2,995,616 | 8/1961 | Nicolas | 174/102 R |
| 3,130,256 | 4/1964 | Mildner | 174/36 |
| 3,287,490 | 11/1966 | Wright | 174/102 D |
| 3,339,007 | 8/1967 | Blodgett | 174/25 |
| 3,509,269 | 4/1970 | Elliott | 174/120 |
| 3,665,096 | 5/1972 | Madle | 174/107 |
| 3,927,247 | 12/1975 | Timmons | 174/36 |
| 3,963,854 | 6/1976 | Fowler | 174/36 |
| 3,968,321 | 7/1976 | Olszewski et al. | 174/36 |
| 4,260,851 | 4/1981 | Smith | 174/107 |
| 4,297,522 | 10/1981 | Jesse et al. | 174/36 |
| 4,319,473 | 3/1982 | Franke, Jr. et al. | 72/196 |
| 4,327,246 | 4/1982 | Kincaid | 174/36 |
| 4,376,229 | 3/1983 | Maul et al. | 174/36 X |

FOREIGN PATENT DOCUMENTS

| | | | |
|---|---|---|---|
| 345249 | 9/1917 | Fed. Rep. of Germany | 72/379 |
| 1046954 | 12/1953 | France . | |
| 476498 | 4/1950 | Italy | 174/102 R |
| 54-214 | 4/1980 | Japan | 72/379 |
| 168499 | 6/1934 | Switzerland | 72/379 |

*Primary Examiner*—A. T. Grimley
*Assistant Examiner*—Morris H. Nimmo
*Attorney, Agent, or Firm*—Donald M. Sell; James A. Smith; William D. Bauer

[57] ABSTRACT

An electrical cable (22, 28) with a sheet material (10) used as air electrical shield having a continuous metallic foil (12) having a plurality of transverse folds (14). The transverse folds (14) are flattened to form a plurality of transverse overlaps (16) of the continuous metallic foil (12) such that the elongation of the sheet material (10) exhibits a nonlinear yield behavior upon the application of longitudinal force (42). In a preferred embodiment, the transverse folds (14) form a plurality of pairs of faces (60, 62) with an interior angle (64) of not more than three degrees. A cable (22, 28) is formed by securing the sheet material (10) to at least one insulation (26) encased conductor (24). The sheet material (10) is formed by corrugating a sheet of continuous metallic foil (12) to form a plurality of flattened transverse folds (14) to form a plurality of continuous overlaps (16).

13 Claims, 12 Drawing Figures

SHEET MATERIAL FOR AND A CABLE HAVING AN EXTENSIBLE ELECTRICAL SHIELD

BACKGROUND OF THE INVENTION

The present invention relates generally to electrical cable shields and more particularly to extensible electrical cable shields.

Electrical cables, especially those cables used for high speed data transmission, radiate and are susceptible to electromagnetic interference (EMI). One means of prevention of EMI is to enclose such electrical cables in metallic, i.e. highly conductive, shields. The conductive shield, if it supplies the required high conductivity and continuous coverage, will prevent EMI from radiating from the cable.

The requirement for a large capacity of signal distribution in a compact cable has been met with the use of a "ribbon" cable in which a large number, e.g., 50, conductors lie in a single plane and are encased in a common insulating material. An example of such a cable is Scotchflex Model 3365 Cable, manufactured by Minnesota Mining and Manufacturing Company, St. Paul, Minn. This cable provides many signal conductors in a compact cable while affording ease of terminability with mass termination equipment.

One means for constructing a shielded ribbon cable is illustrated by Scotchflex Model 3517 Shielded Ribbon Cable. The shield of this cable comprises an expanded copper mesh, e.g., 4CU6-050 flattened annealed copper foil mesh produced by Delker Corporation, wrapped around the cable. This shield provides the advantages of extensibility and mechanical ruggedness. However, because the mesh is open and is inadequately conductive, its shielding characteristics are marginal or inadequate for many uses.

Another means for shielding a ribbon cable or other cable is to cover the cable with a highly conductive metallic foil such as a copper or aluminum. In one common construction the foil is laminated to a polyester film for reinforcement. However, serious problems occur when using foil shields, particularly when the metallic foil is bonded either to the insulation surrounding the signal conductors or to the inner surface of a jacketing material. A continuous foil shield greatly reduces the flexibility of the cable. Both copper foil and aluminum foil tend to crack when repeatedly flexed. As an example, a continuous one mil thick aluminum foil shield bonded to a 50 mil thick cable core can be expected to show evidence of cracking after the second or third bend around a $\frac{3}{8}$ inch diameter mandrel.

Mechanically produced cracks in a ribbon cable usually run transverse to the signal conductors. When using such a cable (a cable with transverse cracks in the shield conductor) in an unbalanced drive situation (a single conductor utilizing a ground return) the shield carries all or part of the return current, the transverse cracks interrupt that current flow resulting in a deleterious effect on cable operation. Cracks enable signal leakage increasing the likelihood of EMI. Even when using such a cable (a cable with transverse cracks in the conductive shield) in balanced drive (a pair of oppositely driven conductors per signal) transverse cracks decrease the shielding effectiveness for common mode (e.g., turn-on pulses and electrostatic discharge sensitivity) and also increases the likelihood of EMI.

The most widely used prior art shield for round cable has been braided wire. When tightly woven and new, a braided wire shield provides high conductivity, high coverage, good to very good shielding and mechanical flexibility and ruggedness. Double layers of braid with silver plating are required for the best shielding performance. Unfortunately, braided wire shields lose effectiveness with age because the connections between wires at cross-overs become unreliable. These conditions are even less certain when a braided shield is woven around a ribbon cable.

Prior art shields have not combined the highly desirable continuous coverage and excellent shielding qualities of metallic foils with the needed flexibility of braided wire.

SUMMARY OF THE INVENTION

The present invention also provides an electrical cable having at least one conductor and insulation encasing the at least one conductor. The cable includes sheet material having a continuous metallic foil having a plurality of flattened transverse folds forming a plurality of transverse overlap of the continuous metallic foil. The transverse folds are transverse to the length of the cable. The sheet material is secured to the insulation. The result is an electrical cable having exceptional shielding characteristics and exceptional flexibility in which the integrity of the electrical shield is reliably maintained during protracted cable flexure.

The structure of the present invention provides a cable having, an extensible electrical shield which retains the desirable electrical characteristics of a continuous shield.

BRIEF DESCRIPTION OF THE DRAWINGS

The foregoing advantages, construction and operation of the present invention will become more readily apparent from the following description and accompanying drawings in which.

DETAILED DESCRIPTION OF THE PREFERRED EMBODIMENTS

Figure 1:
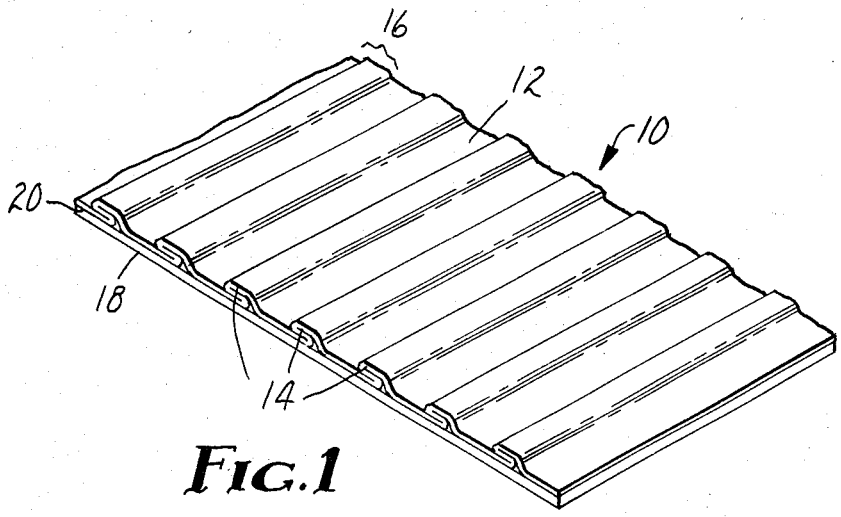
FIG. 1 is a perspective of a sheet material of the present invention with an optional liner.
Figure 2:
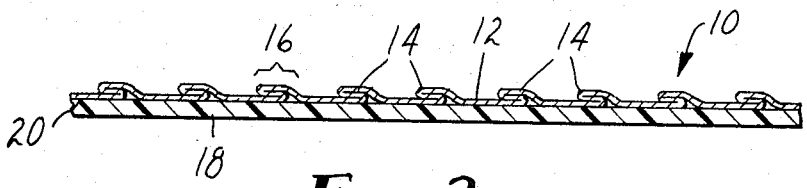
FIG. 2 is a side view of a sheet material of FIG. 1.

The sheet material 10 illustrated in FIGS. 1 and 2 is formed from a continuous metallic foil 12 in which there is formed a plurality of transverse folds 14. The transverse folds 14 are flattened in the sheet material 12 to form an area of overlap 16 which yields surprising and unexpected advantageous performance of this sheet material for use as an extensible electrical shield for an electrical cable. Optionally, the sheet material 10 may contain a liner 18 bonded to the flattened foil 12 with an adhesive 20. The adhesive 20 may either be applied before or after the flattening of the transverse folds of the metallic foil 12. In one embodiment, the adhesive 20 is applied before the sheet material 12 is flattened which results in the inclusion of a small amount of adhesive 20 within the overlap portion 16 of the transverse folds 14. In a preferred embodiment, the transverse folds 14 occur regularly over the longitudinal length of the sheet material 10. In a preferred embodiment, the amount of transverse overlap 16 of each of the plurality of transverse folds 14 is less than one third of the distance between successive ones of the transverse folds 14. In a preferred embodiment, the resulting sheet material 10 has a longitudinal extension of from 15 percent to 100 percent of its nonextended length. In a preferred embodiment, the amount of transverse overlap 16 of each of the plurality of transverse folds 14 is not more than 35 mils. In a preferred embodiment, the thickness of the continuous metallic foil 12 is between one half mil and two mils. The continuous metallic foil 12 may be constructed from a good metallic conductor such as copper or aluminum. The metallic foil 12 should be highly conductive, i.e., exhibit a sheet resistivity of not more than $20\times10^{-3}$ ohms per square. In a preferred embodiment, the transverse folds 14 occur at approximately the rate of 15 transverse folds 14 per inch. In a preferred embodiment, the adhesive 20 is a hot melt adhesive such as an ethylene acrylic acid. In a preferred embodiment, the liner 18 is made from polyester.

The sheet material 10 as illustrated in FIGS. 1 and 2 exhibits a nonlinear yield behavior on the application of longitudinal force. With the longitudinal force below a nominal yield value, the sheet material 10 acts as a continuous foil with a minimal amount of longitudinal extension and generally will return to near its original position upon the removal of that longitudinal force. With the application of a longitudinal force above the nominal yield amount, the sheet material 10 extends quite freely.

For the purposes of the present application, the continuous metallic foil 12 may be purely a metallic foil as a copper or an aluminum foil, but it is preferred that the continuous metallic foil actually comprise a laminate of an aluminum foil with a polyester film. One embodiment utilizes Model 1001 film manufactured by the Facile Division of Sun Chemical Corporation which consists of a laminate of a 0.33 mil aluminum foil to a 0.5 mil polyester film. In this application, all references to a metallic foil 12 include a metallic foil laminate with another conductive or nonconductive material such as polyester. A preferred embodiment utilizes Model 1112 adhesive coated one mil aluminum foil manufactured by the Facile Division of Sun Chemical Corporation. This foil is coated with an ethylene acrylic acid hot melt adhesive which softens around 230° F.

Figure 3:
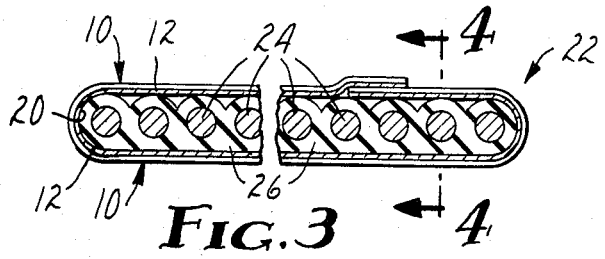
FIG. 3 is an end view of a ribbon cable constructed in accordance with the present invention.

FIG. 3 illustrates an electrical ribbon cable 22 constructed utilizing the sheet material 10. A plurality of conductors 24, which may be signal conductors, lie in a single plane and are encased in an insulating material 26. The insulating material 26 is sandwiched between sheet material 10 and bonded to the sheet material 10 with adhesive 20. The view in FIG. 3 is looking through one of the transverse folds 14 of FIGS. 1 and 2. The conductors 24 and insulation 26 can be of conventional design such as Model 3365 ribbon cable manufactured by Minnesota Mining and Manufacturing Company, St. Paul, Minn. In a preferred embodiment, the conductors 24 are constructed from solid copper and in a preferred embodiment the insulating material 26 is constructed from polyethylene or low loss thermoplastic rubber (TPR).

Figure 4:
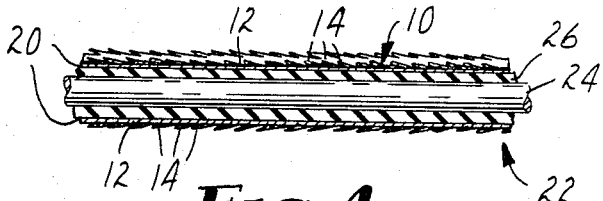
FIG. 4 is a longitudinal cross-section of the cable of FIG. 3 taken along line 4—4.

A longitudinal cross-section of the electrical ribbon cable 22 of FIG. 3 is shown in FIG. 4 which illustrates the transverse folds 14. A conductor 24 is encased in insulating material 26 and cigarette wrapped with sheet material 10 which is bonded to the insulating material 26 with adhesive 20. Adhesive 20 would not be required if, of course, the sheet material 10 already contained an adhesive as illustrated in FIG. 1.

Figure 5:
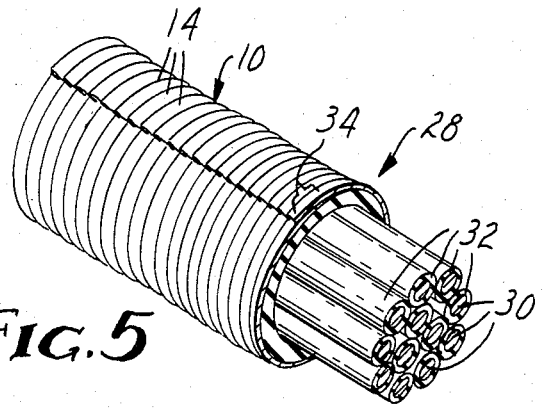
FIG. 5 is a cable constructed in accordance with the present invention having a circular cross section.

FIG. 5 illustrates the use of the sheet material 10 with an electrical cable 28 of circular cross section. The cable 28 consists of a plurality of conductors 30 some of which are surrounded by insulation 32. The conductors 30 are arranged in a generally circular cross section and are wrapped with the sheet material 10 again with the transverse folds 14 running transverse to the longitudinal direction of the cable 28. In this embodiment the sheet material 10 overlaps at overlap portion 34 to insure that the entire cable 28 is adequately shielded.

Figure 7:
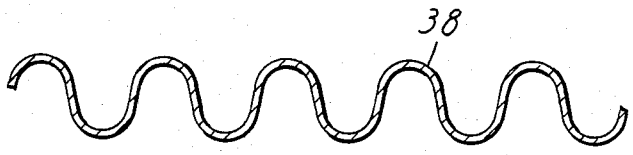
FIG. 7 illustrates an intermediate stage in the fabrication of the sheet material of the present invention.
Figure 8:
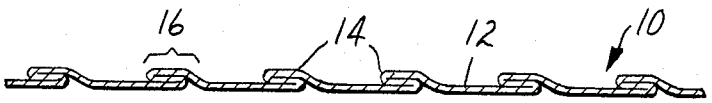
FIG. 8 illustrates the completed sheet material formed from the sheet material of FIG. 7.
Figure 6:
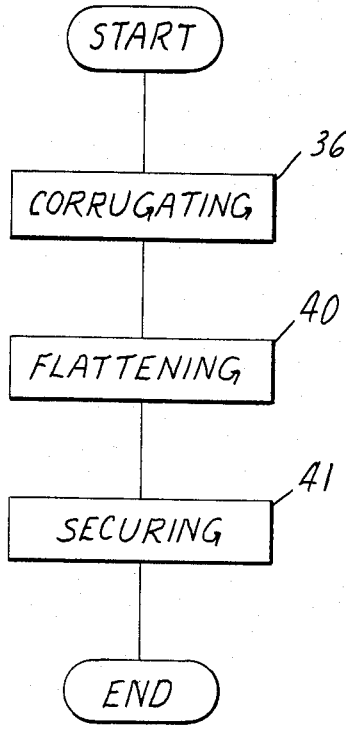
FIG. 6 is a flow diagram illustrating the method of making the sheet material of the present invention.

FIG. 6 illustrates a flow diagram describing the method of constructing the sheet material, and optionally an electrical cable utilizing the sheet material, of the present invention. The sheet material is formed by first corrugating 36 a sheet or strip of continuous metallic foil 12. The resulting corrugated metallic foil 38 is illustrated in FIG. 7. The preferred method of corrugating 36 to the metallic foil 12 is to use two 0.415 inch outside diameter 48 diametral pitch meshing gears, then to run the continuous metallic foil through these meshing gears resulting in a corrugated metallic foil 38 having approximately 15 corrugations per inch. In this preferred form the corrugated metallic foil has an amplitude distance of approximately 35 mils. The corrugated metallic foil 38 is then flattened 40 by sticking one side of the corrugations to a carrier (which may also be a liner) and then using a pair of nip rollers to flatten the corrugated metallic foil 38 to form a plurality of transverse folds 14 having transverse overlaps 16 as illustrated in FIG. 8. The optional step of securing 41 the flattened sheet material 10 to an electrical cable may be accomplished with the use of a suitable adhesive.

In performing the flattening step 40 it is preferred that an adhesive be utilized with the corrugated metallic foil 38 in order to sufficiently adhere the corrugated material 38 to a substrate so that when flattened the corrugations of the corrugated metallic foil 38 would not "creep" while the flattening step 40 is being accomplished. The degree of restraint varys, of course, with the the nature of the corrugated metallic foil 38. It has been found, for example, that with an aluminum foil under 1 mil in thickness that sufficient restraint could be obtained by scraping the corrugated metallic foil 38 flat while the corrugated metallic foil 38 was placed on 60 grit sandpaper. Heavier corrugated metallic foil require additional restraint, for example, a tacky adhesive surface. A usuable substrate, or ultimately a liner, which could be utilized for this restraint is a silicone pressure sensitive adhesive/polyester film tape identified as Model 8402POA manufactured by Minnesota Mining and Manufacturing Company, St. Paul, Minn. This high temperature tape has a very low tack adhesive. The low tack of the adhesive to the substrate is advantageous in order to allow the flattened, corrugated metallic foil, the sheet material 10, to be stripped from the substrate without removing the flattened transverse folds forming a plurality of transverse overlaps.

Figure 9:
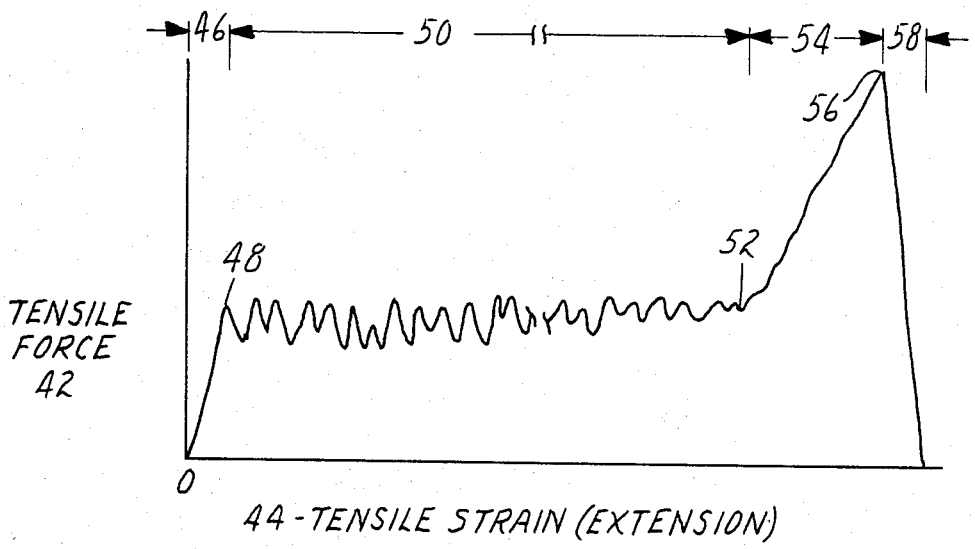
FIG. 9 is a stress-strain diagram illustrating the performance of the sheet material and shield of the cable of the present invention.

FIG. 9 illustrates a stress-strain diagram illustrating the performance of the sheet material 10 of the present invention. In the stress-strain diagram of FIG. 9, the longitudinal force 42, or tensile force, is plotted along the vertical axis while the tensile strain 44, or longitudinal extension, of the sheet material 10 is plotted along the horizontal axis. As illustrated in the diagram, upon the application of the longitudinal force 42, the tensile strain increases substantially linearly in the nonextension region 46 in which the sheet material 10 maintains substantially its original shape. Once the longitudinal force 42 reaches a yield point, illustrated in the diagram as point 48, the transverse folds 14 of the sheet material 10 begin to pull out. The folds continue to pull out during the pull out region 50 until all of the transverse folds 14 are extended at point 52. As the longitudinal force continues to increase, the tensile strain 44 of the sheet material 10 again continues to substantially linearly increase as the fully extended sheet material 10 resists the longitudinal force during the strain region 54. Once the longitudinal force 42 reaches the tensile strength of the materials forming the sheet material 10 at point 56, the sheet material 10 will tear resulting in the rapid decrease in tensile strain 44 during this tear region 58.

As an example of the longitudinal force 42 required at the yield point for differing materials constructed in accordance with the preferred method for making the sheet material 10 are provided as follows:

For a continuous metallic foil of 0.8 mil Reynolds wrap, a yield force of 0.1–0.35 pounds per inch width was obtained;

For a 1145 aluminum, 1 mil annealed, a yield force of from 0.38 to 0.7 pounds per inch width was obtained;

For 1145 aluminum, 1 mil H25 temper, a yield force of from 0.75 to 1.4 pounds per inch was obtained;

For 1145 aluminum, 1.5 mil annealed, a yield force of from 1.5 to 2.3 pounds per inch width was obtained;

For 1 ounce copper, annealed before fabrication, a yield force of from 1.7 to 2.3 pounds per inch width was obtained; and For aluminum 2 mil annealed, a yield force of from 2.0 to 2.5 pounds per inch width was obtained.

Figure 10:
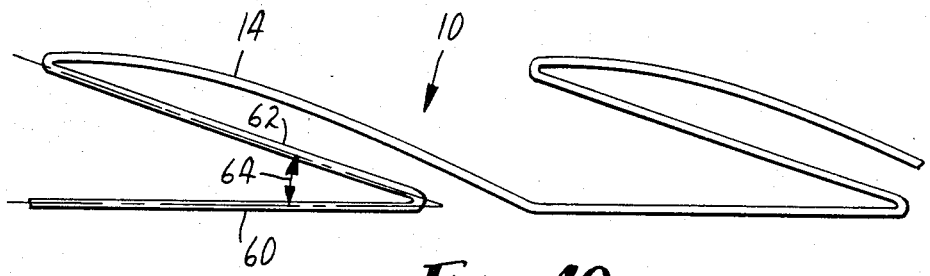
FIG. 10 illustrates a preferred construction of the sheet material useable as an electrical shield.
Figure 12:
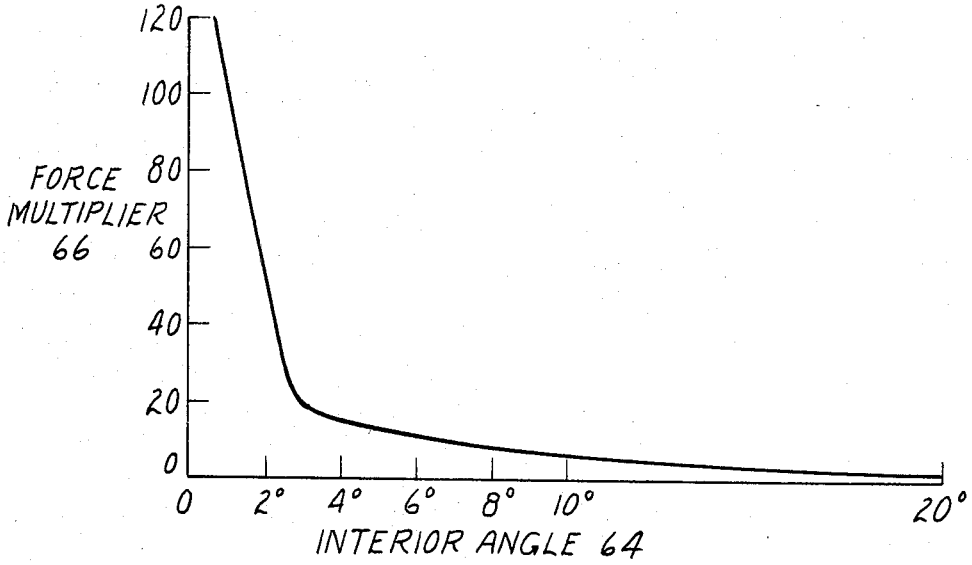
FIG. 12 is a graphical representation of the force multiplier as a function of the interior angle.

FIG. 10 is a side view of sheet material 10 which has formed a transverse fold 14. For purposes of illustration, the diagram in FIG. 10 is distorted. Faces 60 and 62 of transverse folds 14 form an interior angle 64. It has been unexpectedly found that a sheet material 10 made in accordance with the present invention in which the original interior angle 64 of the transverse folds 14 is not more than 3 degrees, that the sheet material 10 exhibits particularly desirable behavior. The tensile force per unit width which is applied longitudinally to the sheet material 10, tends to prevent the opening of the transverse folds 14 of the sheet material 10. For small interior angles 64, most of the tensile force is supported by the compressive force along the face 62 of the transverse fold 14. Only a small extensible force component which is the longitudinal force 42 times the sine of the interior angle 64 acts perpendicular to face 62 to produce a force couple which tends to open the transverse fold 14. A sufficiently small opening force couple will be resisted by slight elastic deformation of the transverse fold principally in the region of face 62 of the transverse fold 14. When the interior angle 64 equals 90 degrees, the opening force equals the applied longitudinal force 42. For all smaller angles, the longitudinal force is larger than the tensile force by the factor of 1 divided by the sine of the interior angle 64. A grasp of this force multiplier function is illustrated in FIG. 12. The force multiplier 66 is a measure of the ability of the transverse fold 14 to behave elastically and to resist opening. It can be seen that the knee of the curve in FIG. 12 is at about 3 degrees of interior angle 64. For an interior angle equal to 3 degrees, the force multiplier 66 is of a sufficiently high value to provide substantially elastic results. For smaller interior angles 64, the force multiplier increases dramatically. For larger interior angles 64 above 3 degrees, the force multiplier 66 decreases and the likelihood of the transverse folds opening under a useful longitudinal force 42 increases.

Figure 11:
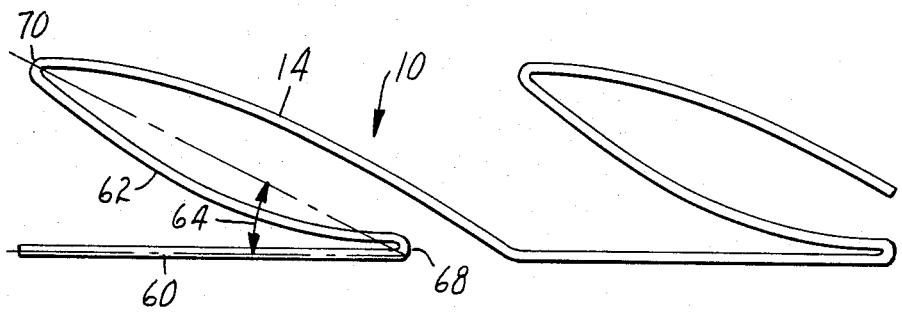
FIG. 11 is an alternative illustration of a preferred construction of a sheet material useable as an electrical shield.

Reference to FIG. 11 will more readily illustrate what is meant by the interior angle 64. Again as sheet material 10 is shown with a transverse fold 14 formd from faces 60 and 62 again the diagram of FIG. 11 is distorted for ease of illustration. Face 62 of transverse fold 14 begins at point 68 at the base of interior angle 64 and continues to point 70 where the sheet material 10 folds back to continue to form the next transverse fold 14. If face 62 is not linear, either by design or subsequent deformation of the sheet material 10, the interior angle 64 is defined by a linear line drawn between points 68 and 70.

Thus, it can be seen that there has been shown and described a novel sheet material for and a cable having extensible electrical shield. It is to be understood, however, that various changes, modifications and substitutions in the form of the details of the present invention can be made by those skilled in the art without departing from the scope of the invention as defined by the following claims.

What is claimed is:

1. An electrical cable, comprising:

at least one conductor;

insulation encasing said at least one conductor;

a sheet material comprising a continuous metallic foil having a plurality of flattened transverse folds forming a plurality of transverse overlaps having a nonlinear yield behavior; and securing means coupling said sheet material to said insulation;

whereby a shielded cable is provided having exceptional flexibility.

2. An electrical cable as in claim 1 wherein said transverse folds of said sheet material form a plurality of pairs of faces with an interior angle, said interior angle being not more than three degrees.

3. A cable as in claim 2 wherein said plurality of transverse folds of said sheet material occur regularly over the longitudinal length of said sheet material.

4. A cable as in claim 2 wherein the amount of said transverse overlap of each of said plurality of transverse folds of said sheet material is less than one-half of the distance between successive ones of said plurality of transverse folds.

5. A cable as in claim 3 wherein said amount of said transverse overlap of each of said plurality of transverse folds of said sheet material is less than one-third of the distance between successive ones of said plurality of transverse folds.

6. A cable as in claim 1 wherein said sheet material has a longitudinal extension of from 15 percent to 100 percent of its non-extended length.

7. A cable as in claim 2 wherein the amount of said transverse overlap of each of said plurality of transverse folds of said sheet material is not more than 35 mils.

8. A cable as in claim 6 wherein the thickness of said continuous metallic foil of said sheet material is between one-half mil and two mils.

9. A cable as in claim 6 wherein said continuous metallic foil of said sheet material is constructed from a material selected from the group consisting of copper and aluminum.

10. A cable as in claim 9 wherein said plurality of transverse folds of said sheet material occur approximately 15 folds per inch.

11. A cable as in claim 1 wherein said securing means comprises an adhesive for adhering said sheet material to said insulation.

12. A cable as in claim 1 in which said at one conductor is a plurality of conductors.

13. A cable as in claim 12 wherein said plurality of conductors lie substantially longitudinally parallel in a single plane.

* * * * *